United States Patent [19]

Corsette

[11] 4,361,256

[45] Nov. 30, 1982

[54] DISPENSER HAVING ATTACHED AND SEALED CLOSURE CAP

[76] Inventor: Douglas F. Corsette, 6559 Firebrand St., Los Angeles, Calif. 90045

[21] Appl. No.: 165,082

[22] Filed: Jul. 1, 1980

[51] Int. Cl.[3] ..... B67D 5/40

[52] U.S. Cl. ..... 222/383; 222/568; 239/333

[58] Field of Search ..... 285/386; 239/333; 215/DIG. 1, 354; 222/568, 383, 385, 482, 372

[56] References Cited

U.S. PATENT DOCUMENTS

| | | | |
|---|---|---|---|
| 3,134,522 | 5/1965 | Shwisha | 222/539 |
| 3,797,749 | 5/1974 | Tada | 239/321 |
| 4,168,788 | 9/1979 | Quinn | 222/383 |

FOREIGN PATENT DOCUMENTS

| | | | |
|---|---|---|---|
| 1479599 | 5/1967 | France | 239/333 |

*Primary Examiner*—Robert J. Spar

*Assistant Examiner*—Patricia Ray

*Attorney, Agent, or Firm*—Watson, Cole, Grindle & Watson

[57] ABSTRACT

A dispenser includes a cylindrical connecting portion, an internally threaded closure cap permanently attached to the connecting portion, and a container for fluid to be dispensed having an externally threaded neck in engagement with the cap. The connecting portion and the cap are interengaged for both effecting the permanent attachment and for producing a fluid-tight seal therebetween. An annular flexible lip on the cap slopes inwardly of the cap and toward the container into engagement with an annular flange provided on the connecting portion. The lip overlies the container neck and is forced into a tight sealing engagement with the connecting portion upon a tightening of the cap onto the container neck. The flange may likewise overlie the container neck so as to be forced into a tight sealing engagement therewith upon the tightening of the cap onto the container neck.

8 Claims, 4 Drawing Figures

DISPENSER HAVING ATTACHED AND SEALED CLOSURE CAP

BACKGROUND OF THE INVENTION

This invention relates generally to a hand-operated dispenser or sprayer in which fluid is dispensed from a container by a pumping action. More particularly, the dispenser has a cylindrical connecting portion to which a closure cap is permanently attached and forms a tight seal therewith.

Dispensers of this general type are typically provided with an internally threaded closure cap for securing the dispenser body to a container of fluid to be dispensed. Normally, a collar or the like is first inserted upwardly through the central opening of the closure cap for engagement therewith and is subsequently attached to the cylindrical connecting portion of the dispenser body. Attachment between the collar and the connecting portion may be effected by spin welding, sonic welding, solvent bonding, snap fitting or some other joining technique.

In another prior art development, U.S. Pat. No. 3,797,749 discloses an assembly which includes a snap fit engagement between the connecting portion of the dispenser body and the closure cap. However, a truncated conical member is required to be inserted into the connecting cylindrical portion to prevent disengagement between the connecting portion and the closure cap. Such an additional insert or collar of the aforementioned type required for effecting attachments between the connecting portion and the closure cap, are cumbersome, involve additional cost and time to manufacture and assemble and are otherwise not fully effective in producing a fluid-type seal between the connected parts and between the collar and the end of the container neck.

SUMMARY OF THE INVENTION

It is therefore an object of the present invention to provide a dispenser having an internally threaded closure cap permanently attached thereto without the need of an extra part or an extra production operation while at the same time improving upon the fluid-tight seal between the closure cap and the connecting portion of the dispenser.

This general objective according to the invention is achieved by the provision of an annular flexible lip on the closure cap which slopes inwardly of the cap and toward the container into engagement with an annular flange provided on the connecting portion, the lip overlying the container neck and being forced into a tight sealing engagement with the connecting portion upon a tightening of the cap onto the container neck. The annular flange may be extended to overlie the neck of the container for bearing thereagainst to improve upon the fluid-tight seal between the container and the connecting portion. Alternatively, the lip may be disposed to bear against the container neck for effecting the tight sealing engagement upon a tightening of the closure cap on the neck of the container, while permitting the dispenser to be rotated relative to the container when desired.

Other objects, advantages and novel features of the invention will become more apparent from the following detailed description of the invention when taken in conjunction with the accompanying drawings.

DETAILED DESCRIPTION OF THE INVENTION

Figure 1:
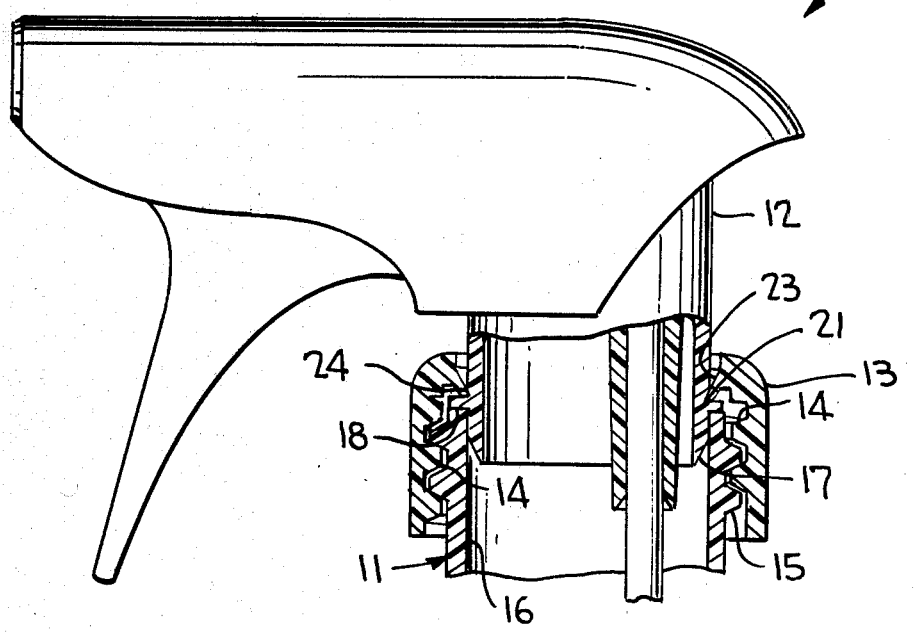
FIG. 1 is a front elevational view of a dispenser body with which the present invention may be incorporated, the closure cap, the connecting portion of the dispenser, and a portion of the container neck being shown in cross-section.
Figure 2:
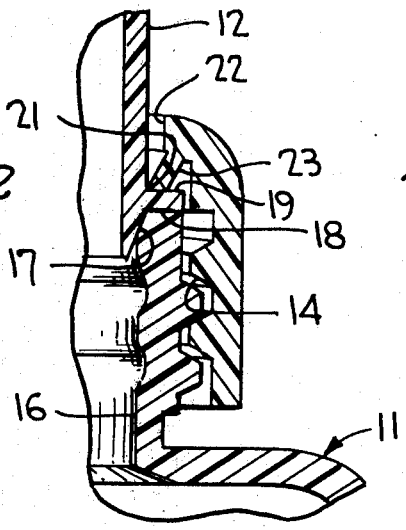
FIG. 2 is a slightly enlarged view, in section, of another embodiment according to the invention.

Turning now to the drawings wherein like reference characters refer to like and corresponding parts throughout the several views, FIG. 1 illustrates a dispenser 10 of the trigger operated type for the dispensing of a fluid upon pumping operation, contained within a bottle or container 11. Of course, finger actuated plungers and sprayers of other types are capable of incorporating the features of the inventions without departing from the spirit thereof. The dispenser has a cylindrical attaching or connecting portion 12 to facilitate attachment of the dispenser to the container by means of a closure cap 13. The closure cap is internally threaded as at 14 for threaded engagement with the external threads 15 of neck 16 of the container. Attaching portion 12 is permanently interconnected with the closure cap by a snap fit engagement between the two members. Portion 12 has an inward taper as at 17 at its terminal end and, in the FIGS. 1 and 2 embodiments, has an annular flange 18 extending radially outwardly of the periphery of portion 12. This flange includes a radial wall 19 having a surface forming an included angle 21 with attaching portion 12. The closure cap has a central opening 22 and an annular skirt or lip 23 adjacent one end thereof as clearly shown in the drawings. The lip is sufficiently flexible to permit attaching portion 12 to be quickly inserted from above the closure cap as the tapered leading end flange 18 by-passes lip 23 which flexes during the insertion process. The dispenser body and the closure cap are thus snap-fitted in place. In the FIG. 2 embodiment, the lip bears against wall 19, formed as an upper surface of flange 18, at the root end of the flange, and both the lip and the flange overlie neck 16 of the container so that, upon a tightening of the closure cap onto the container neck, a tight seal engagement is effected between the closure lip and connecting portion 12 and between flange 19 and the neck of the container.

In the FIG. 1 embodiment, attaching portion 12 is provided with an annular groove 24 having a horizontal wall formed as an inward extension of flange 18 and is thereby uniplanar with the upper surface of this wall. Lip 23 is designed to engage both walls of groove 24 for effecting the tight seal engagement between the connecting portion and the closure cap as the closure cap is tightened down over the neck of the container.

Figure 4:
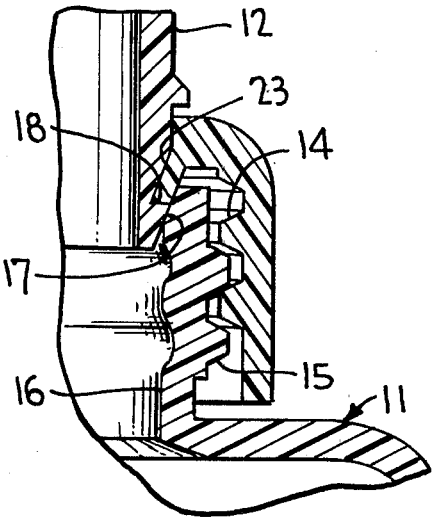
FIG. 4 is a view similar to FIG. 3 showing the neck of the fluid container in relation to the interengaged closure cap and connecting portion of the dispenser.
Figure 3:
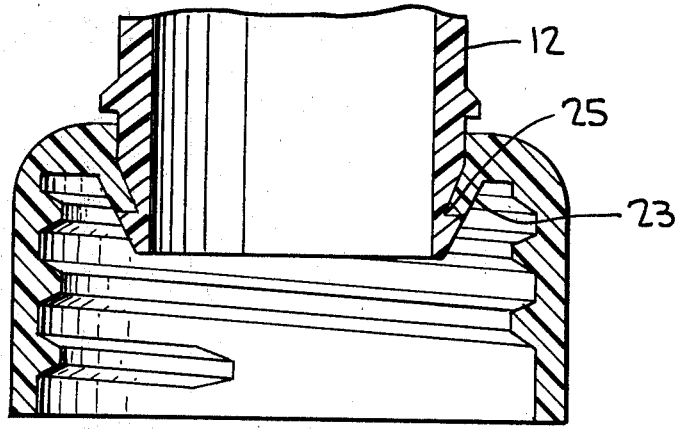
FIG. 3 is a sectional view of still another embodiment according to the invention.

In the FIGS. 3 and 4 embodiment, flange 18 is defined by an annular groove 25 provided along the periphery of portion 12 of the dispenser, and lip 23 engages both walls of groove 25 and bears against the container neck for effecting the tight seal engagement between the closure cap and connecting portion 12 as the closure cap is tightened down over the neck of the container. In this embodiment, the upper portion of the container neck bears mainly against lip 23 thereby permitting the dispenser and its attaching portion 12 to be rotated about a vertical axis relative to the container for orienting the container to some detail or geometry of the container as to azimuth. Thus, the dispenser may be maintained in a desired orientation as the closure cap is assembled to the container. As the closure cap is tightened on the container, the device may maintain the location or orientation as desired especially because of the mechanical advantage of the wedging action of the conical lip as the closure is tightened.

From the foregoing, it can be seen that the permanent snap-fit attachment between the connecting portion and the closure cap likewise functions as an improved seal between the two members and between the dispenser and the container so that the leakage from any container interior through other than the intended discharge outlet of the dispenser is substantially avoided. A collar or insert as otherwise provided by the prior art is, at the same time, avoided by the invention.

Obviously, many modifications and variations of the present invention are made possible in the light of the above teachings. It is therefore to be understood that within the scope of the appended claims the invention may be practiced otherwise than as specifically described.

What is claimed is:

1. In an assembly including a dispenser having a continuous cylindrical connecting portion, a closure cap in engagement with said connecting portion, said cap threadedly engaging the neck of a container of fluid to be dispensed, the improvement wherein interengaging means are provided on said cap and on said portion for positively retaining said dispenser and said closure cap together in a fluid tight manner, said means solely comprising an annular flange on said connecting portion and a flexible conical skirt on said cap, said flange including an upper wall extending radially outwardly, said skirt extending toward said wall and positively engaging the inner terminal end of said flange, and said container neck underlying said skirt, whereby said interengaging means defines a snap-fit engagement between said cap and said connecting portion incapable of disassembly upon threaded engagement between said cap and said neck, and whereby, upon a tightening of the closure cap on the container neck, positive engagement between said conical skirt and said inner terminal end of said flange is improved as the free end of the skirt moves radially inwardly into the root end of the flange in response to said tightening action of the cap and fluid-tight seals are defined between said cap and said portion and between said cap and said container neck.

2. In the assembly according to claim 1, wherein said flange extends outwardly of the periphery of said connecting portion, the undersurface of said flange bearing against said container neck for effecting the fluid-tight seal between said connecting portion and said container upon the threaded engagement between said cap and said container neck.

3. In the assembly according to claim 1, wherein said connecting portion has a peripheral groove defining said upper wall, the undersurface of said flange bearing against said container neck for effecting the fluid-tight seal between said connecting portion and said container upon the threaded engagement between said cap and said container neck.

4. In the assembly according to claim 1, wherein said connecting portion has a peripheral groove defining said upper wall, the undersurface of said conical skirt bearing against said container neck for effecting the fluid-tight seal between said connecting portion and said container upon the threaded engagement between said cap and said container neck, while permitting said body portion to rotate relative to said cap.

5. A dispenser comprising, a body having means thereon for dispensing fluid, said body including a continuous cylindrical attaching portion, an internally threaded closure cap in engagement with said attaching portion, a container for fluid to be dispensed having an externally threaded neck in threaded engagement with said cap, snap-fit interengaging means on said attaching portion and on said cap for positively retaining said portion and said cap together in a fluid-tight manner, said means solely comprising an annular flange on said attaching portion and a flexible conical skirt at one end of said cap, said flange including an upper wall extending radially outwardly, said skirt extending toward said wall and positively engaging the inner terminal end of said flange, said skirt overlying said container neck and the free end of said skirt being forced radially inwardly into said inner terminal end of said flange so as to form a tight seal engagement with said attaching portion upon tightening said cap onto said container neck, and said flange forming a tight seal with said neck upon the tightening of said cap.

6. The dispenser according to claim 5, wherein said flange also overlies said container neck.

7. The dispenser according to claim 6, wherein said attaching portion has an annular groove thereon forming an inward extension of said flange, said free end of said skirt engaging both walls of said groove for effecting the tight seal engagement.

8. The dispenser according to claim 5, wherein said attaching portion has an annular groove thereon defining said flange, said free end of said skirt engaging both walls of said groove and bearing against said container neck for effecting the tight seal engagement.

* * * * *